United States Patent [19]

Mosse

[11] 4,104,849

[45] Aug. 8, 1978

[54] CONTAINER SEALING APPARATUS

[75] Inventor: Richard Wolfgang Emil Mosse, London, England

[73] Assignee: Liquid Packaging Holdings Limited, Stevenage, England

[21] Appl. No.: 768,887

[22] Filed: Feb. 15, 1977

[30] Foreign Application Priority Data

Feb. 16, 1976 [GB] United Kingdom ..... 6044/76

[51] Int. Cl.[2] ..... B65B 7/18; B65B 51/14

[52] U.S. Cl. ..... 53/379; 53/375

[58] Field of Search ..... 53/379, 375

[56] References Cited

U.S. PATENT DOCUMENTS 3,187,646 6/1965 Monroe et al. ..... 53/375 X 3,347,017 10/1967 Allen et al. ..... 53/375 X 3,996,724 12/1976 Smith ..... 53/379 X

*Primary Examiner*—Travis S. McGehee

*Attorney, Agent, or Firm*—Haseltine, Lake & Waters

[57] ABSTRACT

Blank sleeves for forming gable-topped cartons are fed to an opening-out station and a bottom-sealing station. They are then advanced stepwise through pre-folding, filling, heating, panel-turning, and heat-sealing stations. At the panel-turning station, two panel-turning devices turn about fold axes of respective top panels on mountings disposed unilaterally from the respective axes. These devices bring the panels into face-to-face condition obliquely inclined to the carton axis. With the panels in this condition, the carton is forwarded to the heat-sealing station at which water-cooled jaws seal the panels together.

12 Claims, 6 Drawing Figures

CONTAINER SEALING APPARATUS

BACKGROUND OF THE INVENTION

FIELD OF THE INVENTION

This invention relates to a packaging apparatus and a packaging method.

DESCRIPTION OF THE PRIOR ART

U.S. Pat. No. 3,910,014 discloses a packaging apparatus and method in which gable-topped cartons filled with liquid are made from blanks of thermoplastic-coated paperboard. The blanks are formed into sleeves closed at their bottoms. The sleeves are then advanced stepwise through a prebreak or pre-folding station in which top closure panels of each carton are folded inwardly to induce a certain amount of permanent set in score lines separating the top closure panels from side panels of the carton, so that two opposite panels of the four top closure panels already begin to overlie the other two panels of the four; a filling station at which the carton is filled with milk or another liquid; a defoaming station for removing foam from the top of the liquid in the carton; a panel-turning station at which the overlying two panels are turned about respective fold axes formed by their score lines at the adjacent side panels, and are bent at the same time to form two sub-panels which extend horizontally across the carton mouth to a centreline of the mouth and two other sub-panels which extend upwardly from the centreline and sandwich between them sub-panels of the two overlain panels; a welding and sealing station in which these two other sub-panels and the sub-panels sandwiched between them are heat-sealed together to render the carton liquid-tight, while the sub-panels in queston are in a condition obliquely inclined to the vertical axis of the carton; and a closure flap folding and welding station including a heating station wherein the uppermost of the sub-panels is heated and a folding and cooling station wherein this sub-panel is folded downwardly to adhere to the top surface of another sub-panel, and the carton moves beneath a cooling bar to remove heat from the carton top. The sandwich of subpanels is at such an angle to the carton axis that each carton is able to become effectively flat-topped during stacking of the cartons.

At the panel-turning station, the two overlying panels are turned about the fold axes by wedge-shaped blocks which are displaceable to-and-fro by respective hydraulic piston-and-cylinder devices along respective axes which lie in a common vertical plane transverse to the path of advance of the carton. At the welding and sealing station, the upwardly extending sandwich of sub-panels is brought into its obliquely inclined condition against an anvil by an ultrasonic concentrating horn and is welded together in that condition by the heat generated therein by the horn.

Certain problems are encountered with this known apparatus and method. The ultrasonic welding arrangement is expensive and also does not reliably seal the sandwich of sub-panels together. Moreover, the wedge-shaped blocks begin to turn the panels by coming to bear on the panels at linear zones spaced from the fold axes, with the risk that the panels and sometimes even the whole carton top, may be distorted during turning, resulting in poor sealing of the carton at the welding and sealing station, so that the carton produced is not liquid-tight.

British Pat. No. 1,001,597 discloses a packaging apparatus and method in which, again, liquid-filled gable-topped cartons are made from thermoplastic-coated paperboard blanks. The blanks are made into sleeves closed at their bottoms and these sleeves are advanced continuously through stations including a top-breaker station, a filling station, a top-steepling station, a top-heating station, a top-closing station and a top-sealing station.

The top-steepling station comprises a rotary steepling mechanism which restores the top panels to their positions given by the top-breaker station, from which positions the panels may have shifted. The top-heating station comprises electrical radiant heaters disposed above the path of the cartons. The top-closing station comprises fixed ploughs which urge the top panels towards each other and thus bring them into the relative positions required for sealing at the sealing station. The sealing station comprises a rotary top sealer unit including two jaws one of which is displaceable horizontally transversely to the path of the cartons and the other of which is rotatable about a horizontal axis transverse to the path.

A number of problems are encountered with this apparatus and method. The use of fixed ploughs to close the top panels produces a component force upon the top panels in a direction rearwards along the path of the carton, with the result that the panels, which are already hot and thus somewhat flabby, may be distorted in that direction and thus may not be satisfactorily sealed at the sealing station. Furthermore, the continuous advance of the cartons involves the use of rotary multiple units at some of the stations, which units are complicated and costly. This apparatus and method are unsuitable for closing and sealing the top panels to give a sandwich of sub-panels at such an acute angle to the carton axis that the carton is able to become effectively flat-topped, since appropriately shaped fixed ploughs would give to the top panels an additonal unilateral force component which would be transverse to the carton path, thus involving a much greater risk of distortion of the top panels during closing.

SUMMARY OF THE INVENTION

According to one aspect of the present invention, there is provided a method of sealing a container, comprising advancing said container along a path through a heating station, a panel-turning station and a sealing station; at said heating station heating thermoplastic internal surfaces of said container to at least a tacky consistency; at said panel-turning station while said container is stationary power-turning panels of said container, by displacing turning means transversely of said path, to bring the hot thermoplastic internal surfaces to adjacent each other; and at said sealing station while said container is stationary clamping said hot thermoplastic internal surfaces together with cooled clamping means, to seal said container.

According to another aspect of the present invention, there is provided an apparatus for sealing a container having thermoplastic internal surfaces, comprising advancing means for advancing said container along a path through a heating station, a panel-turing station and a sealing station; heating means situated at said heating station for heating said internal surfaces to at least a tacky consistency; panel-turning means situated at said panel-turning station and displaceable transversely of said path to bring the hot thermoplastic internal surfaces to adjacent each other while the container is stationary; and cooled clamping means situated at said sealing station for clamping the adjacent hot thermoplastic internal surfaces together to seal said container while the container is stationary.

According to a further aspect of the present invention, there is provied an apparatus for turning a pack panel about a fold axis, comprising turning means for applying to said panel to turn said panel about said axis, and mounting means spaced from said axis to one side of said axis and mounting said turning means for turning about said axis.

According to a still further aspect of the present invention, there is provided an apparatus for turning around a first fold axis a pack panel including a sub-panel which, in the turned state of the panel, is folded back on another sub-panel of the panel at an acute angle to said other sub-panel and about a second fold axis substantially parallel to said first fold axis, comprising a turning member for applying to said other sub-panel to turn said panel about said axis, a turnable supporting member supporting said turning member and turnable about said first fold axis, pivot means pivotally mounting said turning member on said supporting member for turning about a pivot axis substantially parallel to said second fold axis, and stop means on said supporting member arranged to limit turning of said turning member about said pivot axis in one sense relative to said supporting member in order to transfer the turning force of said supporting member to said turning member for the turning of said panel.

Owing to the invention, it is possible to make filled containers of which closure panels are reliably sealed.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENTS

Figure 1:
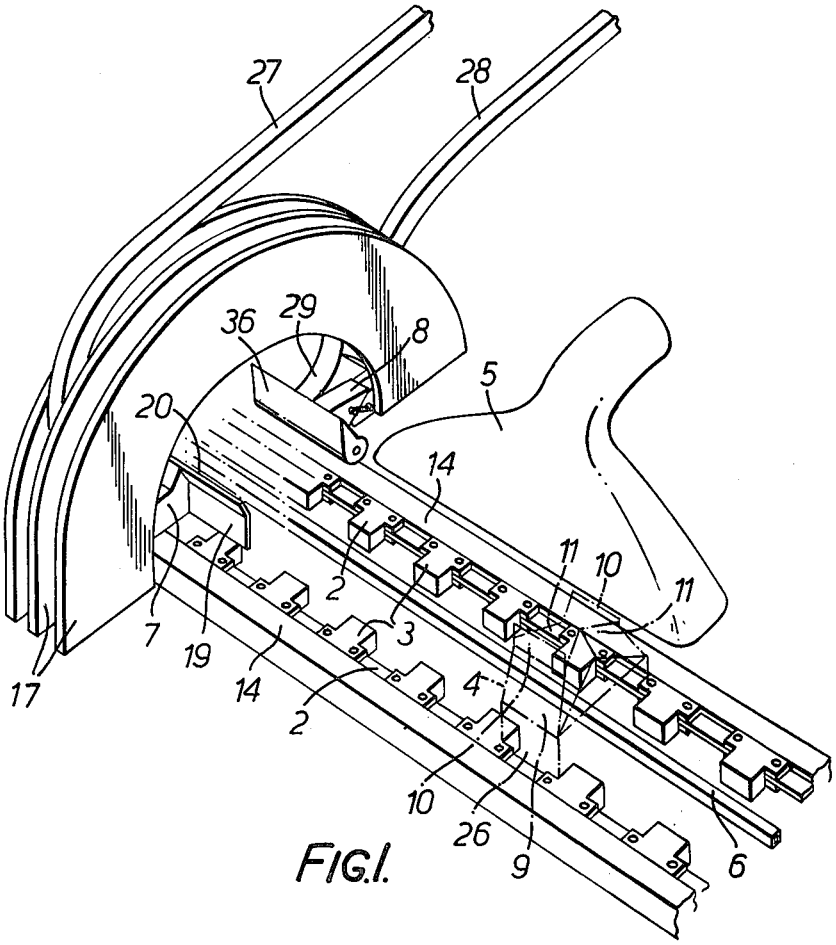
FIG. 1 shows a perspective view of part of a machine for packaging milk, and showing two panel-turning devices thereof in withdrawn positions.

Referring to FIGS. 1 to 5, the machine consists of a number of stations, some of which are shown. Blank sleeves for forming gable-topped cartons and externally and internally coated with thermoplastics are fed into the machine and opened out at a first station in a per se known manner. At a second station, these sleeves have pre-scored bottom flaps thereof heat-sealed together to form open-topped cartons, also in a per se known manner. These cartons are automatically placed with their bottoms on a horizontal guide rail 1 and with their vertical edges loosely engaged by horizontal, endless, stepping chains 2 including dogs 3. These stepping chains advance the cartons step-wise in such a manner that the cartons are temporarily stationary at each of the following stations. The first station along the line of the chains 2 is one in which pre-scored top panels of the cartons are pre-folded in a per se known manner to assume a partly open-topped form shown in dash-dot lines at 4 in FIG. 1. This is a conventional pre-folded form for a gable-topped carton. At a per se known second station along the line of the chains 2, each carton is filled with a dosed quantity of milk. It is then forwarded by the chains 2 to a per se known third station, shown in FIG. 1, at which a hot-air blower 5 blows hot air inside the top of each carton to heat the internal thermoplastics coating in the region of the mouth of the carton to a tacky consistency. Extending parallelly to the horizontal guide 1 at respective opposite sides of the path of the cartons are two water-cooled guide bars 6 for contacting the respective opposite sides of each carton. The cartons are advanced by the chains 2 to a panel-turning station also shown in FIG. 1, where respective opposite panel-turning devices 7 and 8 turn inwards the roof panels of the gable top. Each of these panels comprises an inclined sub-panel 9 and an upright uppermost sub-panel 10. These devices 7 and 8 also bring the upright, uppermost sub-panels 10 of each carton into a condition in which they are disposed face-to-face adjacent to each other, with the interposition of other sub-panels 11, but are obliquely inclined to the vertical axis of the carton, as seen more clearly in FIG. 2. The devices 7 and 8 hold the gable-topped carton in its fully folded condition (i.e. with the sub-panels 9 horizontal and the sub-panels 10 at the required obliquity to the vertical) sufficiently loosely that the chains 2 can readily advance the carton to the fifth and final station, where two sealing jaws 12 and 13 clamp the sub-panels 10 and the interposed sub-panels 11 together for a short interval of time sufficient to cause their tacky surfaces to adhere sealingly to each other. The chains 2 deliver the finished packs at a delivery location which is not shown.

Figure 2:
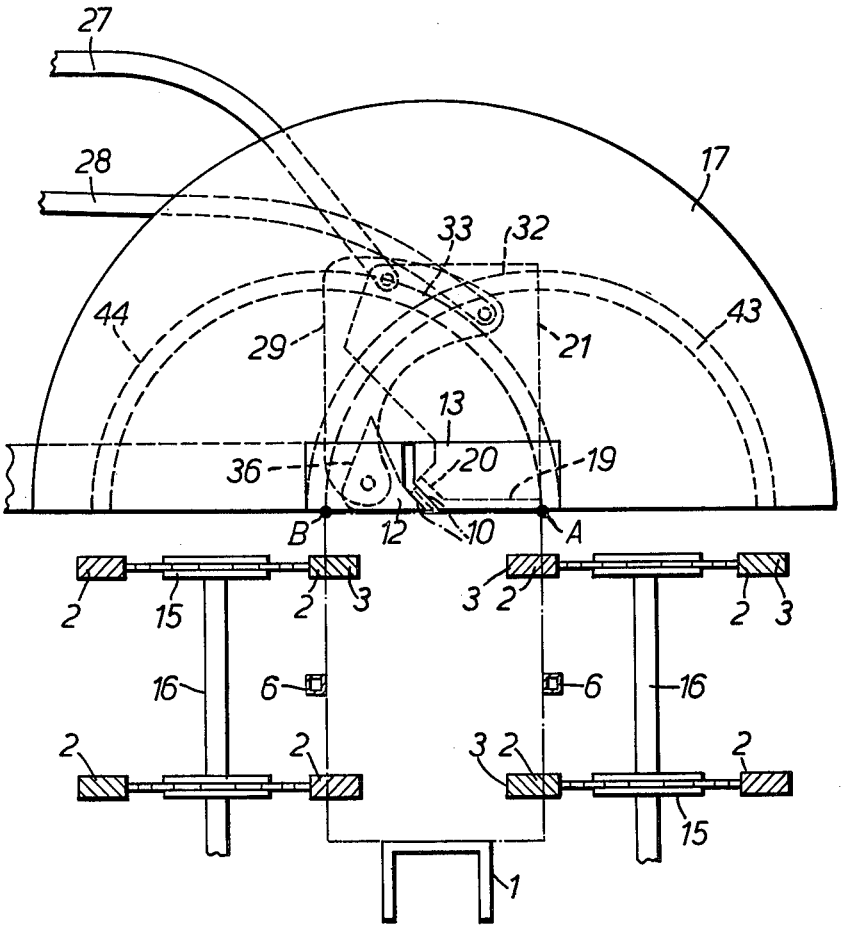
FIG. 2 shows an end elevation of that part, but with the panel-turning devices in fully advanced positions.
Figure 3:
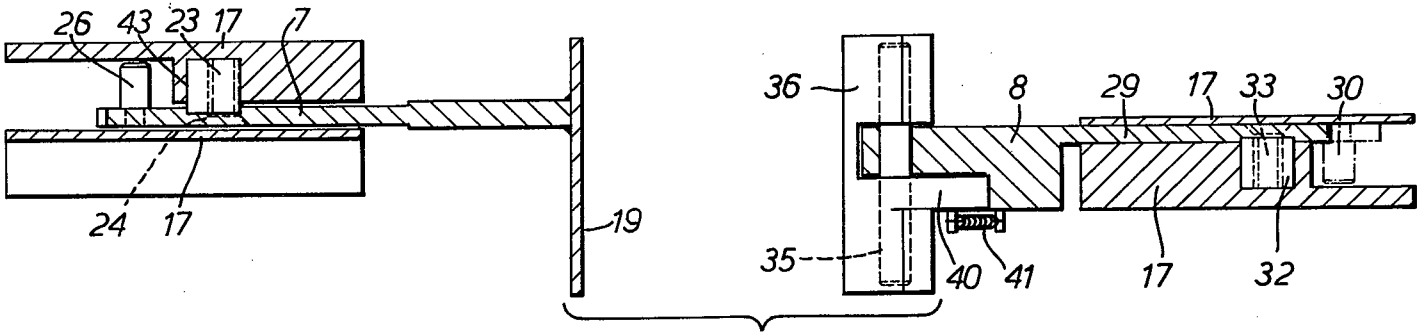
FIG. 3 shows a section through that part at the region of the panel-turning devices.
Figure 4:
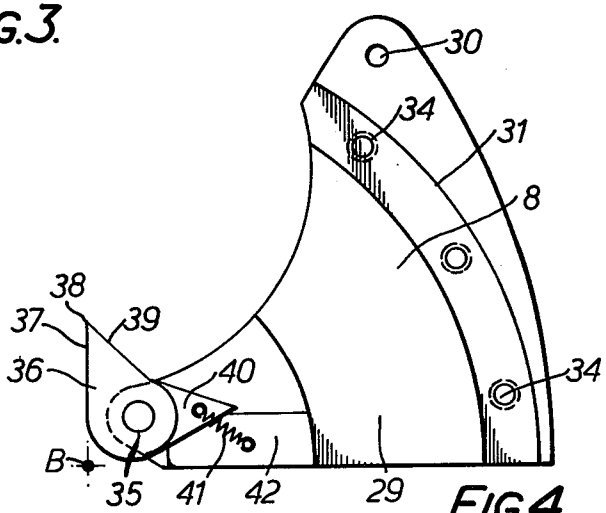
FIG. 4 shows an end elevation of one of the two panel-turning devices.
Figure 5:
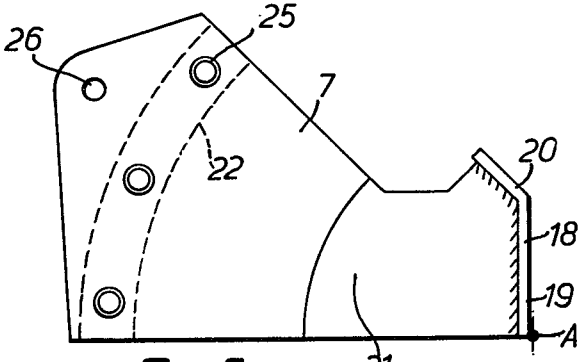
FIG. 5 shows an end elevation of the other panel-turning device.

The chains 2 pass along horizontal guide rails 14 over their straight runs but, at the ends of the guide rails 14, pass around driving sprocket wheels 15 mounted in pairs on vertical driving spindles 16. The path of the cartons being advanced by the chains 2 is bridged by a group of vertical guiding and covering plates 17 for the devices 7 and 8 and the jaws 12 and 13. The device 7 includes a plate 18 consisting of two planar parts 19 and 20, whereof, in the fully folded condition of the gable top, the part 19 is horizontal and is holding the sub-panel 9 horizontal, as shown in FIG. 2, and the part 20 is at an oblique angle to the part 19 to define the desired oblique sealing angle for the sub-panels 10. The plate 18 is welded to a vertical plate 21 which, as can be seen from FIG. 5, widens outwardly away from the plate 18. At its outer region, the plate 21 is formed with an arcuate slot 22 for receiving an arcuate slide 23 which is firmly fastened thereto by screws 24 extending through holes 25 in the plate 21. The slot 22 and the slide 23 are concentric with the fold axis A of the sub-panel 9, where the sub-panel is fixed to the adjacent side sub-panel 26 of the carton. At its outermost end, the plate 21 is provided with a horizontal pivot pin 26 to which is connected a cam-reciprocated arm 27 which drives the device 7. A similar, cam-reciprocated arm 28 drives the device 8. The latter includes a vertical plate 29 which has fixed thereto at its outermost end a horizontal pivot pin 30 whereby it is articulated to the arm 28. In the outer region of the plate 29 is formed an arcuate slot 31 receiving an arcuate slide 32 fixed in the slot 31 by means of screws 33 extending through holes 34 in the plate 29. The slot 31 and the slide 32 are concentric with the fold axis B of the sub-panel to be turned to a horizontal position by the device 8. At its innermost end, the plate 29 carries a pivot pin 35 having its axis parallel with the axis B. Mounted on the pivot pin 35 is a panel-turning member 36 which has a planar surface 37 which is to be applied against the sub-panel to be turned inwards, an acute-angled edge 38 which extends parallel to the axis B and of which the acute angle is equal to the obliquity of the part 20 relative to the plane of the part 19, and a surface 39 which, in the finally folded condition of the gable top, is contacted by the relevant folded-back sub-panel 10. Projecting away from the surface 37 at the opposite side of the member 36 is a projecton 40 of the member 36, which projection is urged by a tension spring 41 against a stop 42 fixed to the plate 29. The slide 23 slides in a co-axial slideway slot 43 formed in one of the plates 17. Similarly, the slide 32 slides in a slot 44 formed in another of the plates 17.

As the device 8 turns the relevant sub-panel inwards to a horizontal position by means of the surface 37, the stop 42 prevents the member 36 from turning relative to the advancing plate 29. However, as the plate 29 withdraws, the edge 38 is initially prevented from moving upwards by the presence of the sub-panels 10 backed by the planar part 20, and thus the member 36 remains in the position shown in FIG. 2 until the plate 29 has withdrawn sufficiently far to allow the edge 38 to escape from beneath the sub-panels 10, the spring 41 thereupon returning the member 36 into contact with the stop 42.

The jaws 12 and 13 are both water-cooled in order to solidify the tacky thermoplastics coatings of the relevant sub-panels as quickly as possible in the short interval of time available. The jaw 13 is fixed in position, whilst the jaw 12 can reciprocate horizontally and perpendicularly to the path of the cartons, between the clamping position shown in FIG. 2 and a release position a very short distance to the left of the clamping position in FIG. 2.

In the above-described machine, the fact that the moving jaw 12 is reciprocated horizontally can be disadvantageous in that the actual clamping force between the jaws 12 and 13 is only a component of the horizontal force urging the jaw 12 towards the jaw 13.

In order to enable a somewhat higher clamping pressure to be obtained for the jaws, and also in order to permit a more accurate retention of alignment of the sub-panels 10 during the sealing by the clamping jaws, it is possible to modify the machine as will now be described with reference to FIG. 6.

Figure 6:
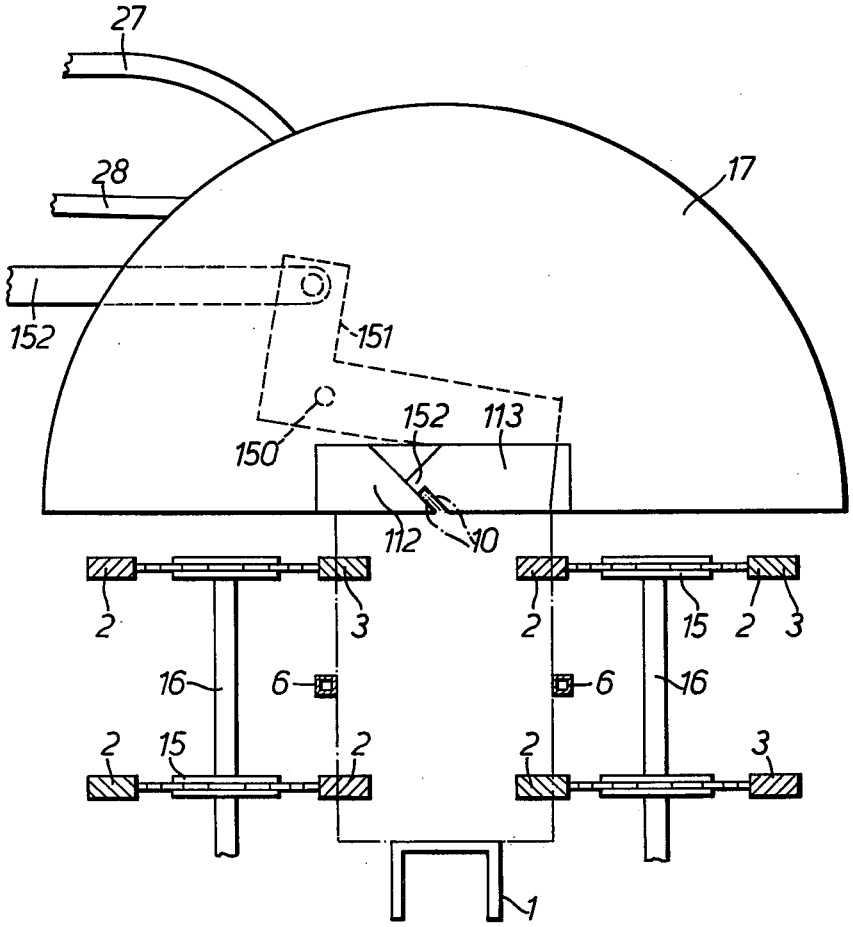
FIG. 6 is a view similar to FIG. 2, but showing a modified version.

In FIG. 6, of the pair of jaws 112 and 113, the jaw 112 is fixed and the jaw 113 is turnable about a horizontal pivot pin 150 relative to the jaw 112. The axis of the pivot pin 150 lies in the clamping plane of the jaws 112 and 113, that is to say the clamping force applied by the jaw 113 is at right-angles to the clamping plane and thus to the sub-panels 10. The jaw 113 is fixed to one end of a two-armed lever 151 carried on the pivot pin 150, the other end of the lever 151 being articulated to a cam-reciprocated arm 152. In order to prevent the jaws 112 and 113 from over-compressing the seal, the clamping face of the jaw 113 is provided with a projection 152 therefrom which is arranged to abut the fixed jaw 112. Not only does the projection 152 limit movement of the jaw 113 towards the jaw 112, but it also serves to align the uppermost edges of the sub-panels 10 with each other, so that the sub-panels 10 are not sealed while in a misaligned condition.

The apparatus described with reference to the drawings enables continuous production of cartons whereof the roof fins provided by the sub-panels 10 are oblique to the vertical and can, without too great a stress on the seal, subsequently be caused to take up a substantially horizontal orientation. For this reason, the packs produced can be satisfactorily stacked upon one another.

I claim:

1. An apparatus for sealing a container having thermoplastic internal surfaces, comprising: advancing means for advancing said container along a path through a heating station; a panel-turning station and a sealing station; heating means situated at said heating station for heating said internal surfaces to at least a tacky consistency; panel-turning means situated at said panel-turning station being displaceable transversely of said path to bring the hot thermoplastic internal surfaces adjacent to each other while the container is stationary, said panel-turning means being turnable about respective fold axes of said panels; mounting means at said panel-turning station spaced unilaterally from the respective axes and mounting said panel-turning means for turning about the respective axes, said mounting means comprising first and second arcuate slide-in-slot arrangements concentric with said fold axes, and cooled clamping means situated at said sealing station for clamping adjacent hot thermoplastic internal surfaces together to seal said container while the container is stationary; said panel-turning means being defined by first and second panel-turning members mounted by said respective slide-in-slot arrangements.

2. An apparatus for sealing a container having thermoplastic internal surfaces, comprising: advancing means for advancing said container along a path through a heating station; a panel-turning station and a sealing station; heating means disposed at said heating station for heating said internal surfaces to at least a tacky consistency; panel-turning means situated at said panel-turning station being displaceable transversely of said path to bring hot thermoplastic internal surfaces to adjacent each other while said container is stationary, said panel-turning means being turnable about respective fold axes of said panels; mounting means at said panel-turning station being spaced unilaterally from the respective axes and mounting said panel-turning means for turning about the respective axes; and cooled clamping means situated at said sealing station for clamping said adjacent hot thermoplastic internal surfaces together to seal said container while the container is stationary; said panel-turning means having a first panel-turning member turnable about one of said fold axes, and a second panel-turning member and a turnable supporting member both turnable about the other of said fold axes; pivot means and stop means on said supporting member, the first panel-turning member having a first planar surface extending substantially axially of one of said fold axes and a second planar surface extending at an obtuse angle to said first planar surface and in a plane parallel to said one of said fold axes; said second panel-turning member having a third planar surface which during panel-turning extends substantially axially of said other of the fold axes; a fourth planar surface extending at an acute angle, complementary to said obtuse angle, to said third planar surface and, during panel-turning, in a plane parallel to said other of said fold axes; said pivot means pivotally mounting said second panel-turning member on said supporting member for turning about a pivot axis substantially parallel to said other of said fold axes; and said stop means being disposed to limit turning of said second panel-turning member about said pivot axis relative to said supporting member, in order to transfer the turning force of said supporting member to said second panel-turning member for panel turning.

3. An apparatus according to claim 2, wherein said panel-turning means further comprises biassing means urging said second panel-turning member in said one sense.

4. An apparatus according to claim 2, wherein said panel-turning means further comprises another turnable supporting member turnable about said one of said fold axes, said first panel-turning member being fixed to said other turnable supporting member.

5. An apparatus for sealing a container having thermoplastic internal surfaces, comprising: advancing means for advancing said container along a path through a heating station; a panel-turning station; a sealing station; heating means disposed at said heating station for heating said internal surfaces to at least a tacky consistency; panel-turning means disposed at said panel-turning station being displaceable transversely of said path, to bring the hot thermoplastic internal surfaces adjacent to each other while the container is stationary; said panel-turning means being turnable about respective fold axes of said panels; mounting means at said panel-turning station spaced unilaterally from the respective axes and mounting said panel-turning means for turning about the respective axes; guide plates at said panel-turning station extending in planes transverse to said path; said panel-turning means having first and second panel-turning members; first and second turnable supporting members carrying the respective panel-turning members being carried by said mounting means and slidingly guided among said guide plates; and cooled clamping means situated at said sealing station for clamping adjacent hot thermoplastic internal surfaces together to seal said container while said container is stationary.

6. An apparatus for sealing a container having thermoplastic internal surfaces, comprising: advancing means for advancing said container along a path through a heating station; a panel-turning station; a sealing station; heating means situated at said heating station for heating said internal surfaces to at least a tacky consistency; panel-turning means situated at said panel-turning station being displaceable transversely of said path to bring the hot thermoplastic internal surfaces adjacent to each other while the container is stationary; said panel-turning means being turnable concentrically about respective fold axes of said panels; mounting means at said panel-turning station spaced unilaterally from the respective axes and mounting said panel-turning means for turning concentrically about the respective axes; and cooled clamping means disposed at said sealing station for clamping said adjacent hot thermoplastic internal surfaces together to seal said container while the container is stationary.

7. An apparatus according to claim 6, wherein said clamping means comprises first and second jaws having respective clamping faces, the first jaw being substantially fixed, and the second jaw being movable towards and away from the first jaw.

8. An apparatus according to claim 7, wherein said second jaw is turnable towards and away from the first jaw about an axis extending substantially in the clamping plane of said jaws.

9. An apparatus according to claim 7, and further comprising a projection of one of said jaws limiting the extent of approach of said clamping faces towards each other.

10. An apparatus as claimed in claim 9, wherein said projection also serves to align edges of said panels extending along said path.

11. An apparatus for turning a pack panel about a fold axis, comprising turning means for applying to said panel to turn said panel concentrically about said axis, and mounting means spaced from said axis to one side of said axis and mounting said turning means for turning concentrically about said axis.

12. An apparatus for turning around a first fold axis and a pack panel including a sub-panel which, in the turned state of the panel, is folded back on another sub-panel of the panel at an acute angle to said other sub-panel and about a second fold axis substantially parallel to said first fold axis, comprising a turning member for applying to said other sub-panel to turn said panel about said axis, a turnable supporting member supporting said turning member and turnable about said first fold axis, pivot means pivotally mounting said turning member on said supporting member for turning about a pivot axis substantially parallel to said second fold axis, and stop means on said supporting member arranged to limit turning of said turning member about said pivot axis in one sense relative to said supporting member in order to transfer the turning force of said supporting member to said turning member for the turning of said panel.

* * * * *